US009186290B2

(12) United States Patent
Fowler

(10) Patent No.: US 9,186,290 B2
(45) Date of Patent: Nov. 17, 2015

(54) MOLDABLE SEATING SYSTEM

(75) Inventor: Rebecca Fowler, Waterford, WI (US)

(73) Assignee: THE COMFORT COMPANIES, INC., Bozeman, MT (US)

( * ) Notice: Subject to any disclaimer, the term of this patent is extended or adjusted under 35 U.S.C. 154(b) by 253 days.

(21) Appl. No.: 13/407,610

(22) Filed: Feb. 28, 2012

(65) Prior Publication Data

US 2013/0221724 A1 Aug. 29, 2013

Related U.S. Application Data

(60) Provisional application No. 61/447,432, filed on Feb. 28, 2011.

(51) Int. Cl.

| | |
|---|---|
| ***A47C 7/02*** | (2006.01) |
| ***A47C 31/12*** | (2006.01) |
| ***A61G 5/10*** | (2006.01) |
| *A61G 7/057* | (2006.01) |

(52) U.S. Cl.

CPC ..... *A61G 5/1043* (2013.01); *A47C 31/126* (2013.01); *A61G 7/057* (2013.01); *A61G 2005/1045* (2013.01); *A61G 2005/1048* (2013.01)

(58) Field of Classification Search

USPC ..... 297/452.55, 452.56, 452.21, 452.22, 297/452.23, 452.28, 284.3

See application file for complete search history.

(56) References Cited

U.S. PATENT DOCUMENTS

| | | | | | |
|---|---|---|---|---|---|
| 3,081,129 | A | * | 3/1963 | Ridder | 297/452.28 |
| 3,830,896 | A | * | 8/1974 | Flicker et al. | 64/45.2 |
| 4,285,544 | A | * | 8/1981 | Zapf | 297/440.21 |
| 4,367,897 | A | * | 1/1983 | Cousins | 297/284.3 |
| 4,484,778 | A | * | 11/1984 | Cousins et al. | 297/284.3 |
| 4,592,587 | A | * | 6/1986 | Cousins et al. | 297/284.3 |
| 4,615,856 | A | * | 10/1986 | Silverman | 264/222 |
| 4,658,807 | A | * | 4/1987 | Swain | 602/19 |
| 4,688,853 | A | * | 8/1987 | Watts | 297/452.28 |
| 4,711,496 | A | * | 12/1987 | Lathers et al. | 297/452.55 |
| 4,763,951 | A | * | 8/1988 | Silverman | 297/440.15 |
| 4,828,325 | A | * | 5/1989 | Brooks | 297/452.28 |
| 4,944,554 | A | * | 7/1990 | Gross et al. | 297/284.3 |
| 5,074,620 | A | * | 12/1991 | Jay et al. | 297/337 |
| 5,102,195 | A | * | 4/1992 | Axelson et al. | 297/440.22 |
| 5,217,278 | A | * | 6/1993 | Harrison et al. | 297/284.7 |
| 5,328,245 | A | * | 7/1994 | Marks et al. | 297/284.3 |
| 5,340,197 | A | * | 8/1994 | Vogtherr | 297/452.12 |

(Continued)

FOREIGN PATENT DOCUMENTS

| | | | | | |
|---|---|---|---|---|---|
| DE | 3106882 | A1 | * | 12/1982 | A47C 31/12 |
| EP | 405681 | A1 | * | 1/1991 | A47C 7/42 |

(Continued)

*Primary Examiner* — David E Allred

(74) *Attorney, Agent, or Firm* — Joseph S. Heino; Patrick M. Bergin

(57) ABSTRACT

A moldable seating system for use with a cushion comprising a moldable seat base and a moldable backrest. The moldable seat base comprises a central portion and a perimeter having a plurality of individually adjustable fingers extending there from. The moldable backrest comprises a moldable center backrest portion and a head support portion. The sides of the moldable center backrest portion comprise a plurality of individually adjustable fingers extending there from. Each of the individual fingers of the moldable seat base and the moldable backrest may be further divided into individually adjustable sections.

4 Claims, 4 Drawing Sheets

(56) References Cited

U.S. PATENT DOCUMENTS

| | | | | | |
|---|---|---|---|---|---|
| 5,470,590 | A * | 11/1995 | Brubaker et al. | 425/2 |
| 5,551,756 | A * | 9/1996 | Gurasich et al. | 297/440.2 |
| 5,558,398 | A * | 9/1996 | Santos | 297/284.3 |
| 5,651,583 | A * | 7/1997 | Klingler et al. | 297/284.4 |
| 5,681,092 | A * | 10/1997 | Hanson et al. | 297/452.41 |
| 6,095,611 | A * | 8/2000 | Bar et al. | 297/440.21 |
| 6,257,664 | B1 * | 7/2001 | Chew et al. | 297/284.9 |
| 6,609,754 | B2 * | 8/2003 | Rajasingham | 297/284.3 |
| 6,659,553 | B2 * | 12/2003 | Achleitner et al. | 297/284.9 |
| 6,910,736 | B2 * | 6/2005 | White | 297/284.3 |
| 6,918,634 | B2 * | 7/2005 | Elliot | 297/284.4 |
| 7,032,971 | B2 * | 4/2006 | Williams | 297/284.4 |
| 7,140,057 | B2 * | 11/2006 | Hetzel et al. | 5/653 |
| 7,273,252 | B2 * | 9/2007 | Iijima et al. | 297/284.3 |
| 7,396,079 | B2 * | 7/2008 | Heidmann et al. | 297/285 |
| 7,784,871 | B2 * | 8/2010 | Cochran | 297/338 |
| 7,896,438 | B2 * | 3/2011 | Whelan et al. | 297/284.4 |
| 7,909,402 | B2 * | 3/2011 | Chu et al. | 297/284.3 |
| 8,177,302 | B2 * | 5/2012 | Carlson et al. | 297/452.64 |
| 8,590,978 | B2 * | 11/2013 | Jaranson et al. | 297/452.15 |
| 2001/0008955 | A1 * | 7/2001 | Garth | 602/19 |
| 2003/0164634 | A1 * | 9/2003 | Da Silva | 297/284.4 |
| 2004/0007910 | A1 * | 1/2004 | Skelly | 297/406 |
| 2004/0039316 | A1 * | 2/2004 | Smith | 602/6 |
| 2004/0195882 | A1 * | 10/2004 | White | 297/284.3 |
| 2004/0245823 | A1 * | 12/2004 | Ligon et al. | 297/284.4 |
| 2004/0256899 | A1 * | 12/2004 | Moore et al. | 297/284.3 |
| 2006/0255635 | A1 * | 11/2006 | Iijima et al. | 297/284.3 |
| 2007/0057562 | A1 * | 3/2007 | Gregory et al. | 297/452.21 |
| 2007/0222270 | A1 * | 9/2007 | Combest | 297/452.21 |
| 2008/0035156 | A1 * | 2/2008 | Hyde et al. | 128/845 |
| 2009/0134686 | A1 * | 5/2009 | Naito et al. | 297/452.55 |
| 2009/0179478 | A1 * | 7/2009 | Frady | 297/452.55 |
| 2010/0140998 | A1 * | 6/2010 | Walker | 297/284.1 |
| 2010/0187888 | A1 * | 7/2010 | Gallegos | 297/411.2 |
| 2010/0218315 | A1 * | 9/2010 | Hyde et al. | 5/613 |
| 2010/0282902 | A1 * | 11/2010 | Rajasingham | 244/118.6 |
| 2012/0133183 | A1 * | 5/2012 | Kim et al. | 297/284.4 |
| 2013/0180530 | A1 * | 7/2013 | Choi et al. | 128/889 |
| 2013/0180531 | A1 * | 7/2013 | Choi et al. | 128/889 |

FOREIGN PATENT DOCUMENTS

| | | | | |
|---|---|---|---|---|
| JP | 05146343 | A * | 6/1993 | A47C 7/46 |
| JP | 05176821 | A * | 7/1993 | A47C 7/34 |
| JP | 05176822 | A * | 7/1993 | A47C 7/34 |

* cited by examiner

MOLDABLE SEATING SYSTEM

This application claims the benefit and priority of U.S. Provisional Patent Application No. 61/447,432 filed Feb. 28, 2011.

FIELD OF THE INVENTION

The claimed invention relates generally to seating systems and in particular to wheelchair seating systems. More specifically, the claimed invention is directed to a moldable seat base for use in connection with a seat cushion and a moldable backrest for use in connection with a seat back.

BACKGROUND OF THE INVENTION

People who spend a significant amount of time sitting, particularly those who are confined to wheelchairs need a comfortable, safe, supportive and adaptable seating system to improve their quality of life. An uncomfortable seat can cause a wheelchair occupant to become anxious or agitated, which will correspondingly reduce quality of life. Such patients may move around considerably in an effort to become comfortable, which could lead to poor posture and eventual spinal problems. The result of such movement can also cause difficulty breathing.

Additionally, patients who require the almost constant use a wheelchair may have impaired sensation in the area of contact with a seating system or may be unable to shift their weight due to one of the following diagnoses: spinal cord injury resulting in quadriplegia or paraplegia, other spinal cord disease, multiple sclerosis, other demyelinating disease, cerebral palsy, anterior horn cell diseases including amyotrophic lateral sclerosis, post polio paralysis, brain injury resulting in quadriplegia, spina bifida, childhood cerebral degeneration, Alzheimer's disease or Parkinson's disease. For these people, it is imperative that the seating system relieve pressure on the patient's body, particularly over bony prominences. Failure of a seating system to adequately relieve pressure may result in the formation of life threatening decubitus ulcers as the skin and muscle breaks down over bony prominences.

Additionally, seating systems need to provide a balance between support for the patient and restriction of the patient's daily activities. For example, if the patient has difficulty sitting due to problems with controlling motion, weakness in one part of the body or muscle spasticity, the seating system should provide enough support to allow the patient to feel safe and secure in his/her posture. Too much support may hinder a patient's function and quality of life, restricting the patient's ability to eat, dress, work, learn, communicate and get around in the wheelchair. Too little support and the patient may attempt to "fix" his/her own posture. Sometimes, posture "fixing" can lead to contractures and deformities such as kyphosis or scoliosis and can hinder blood flow, digestion and breathing.

The seating system needs to be adaptable to the changing needs of the patient. Pediatric patients grow. Patients of all ages gain and lose weight. Patient's health conditions change over time. Additionally, patients are generally routinely reevaluated to ensure continued progress. To the extent that such progress, or lack thereof, dictates that changes be made to a patient's seating system, a seating system should be adaptable to accommodate the changing needs of the patient.

SUMMARY OF THE INVENTION

In view of the foregoing, what is needed is a moldable seating system that can be placed into a wide variety of available cushions to customize the cushion for a particular patient or patient condition. A further requirement is that the moldable seating system employ a lightweight, high strength aluminum alloy that is preferably coated with vinyl or the like to protect the patient and the therapist from any sharp edges. The moldable seating system should be moldable by hand or with the assistance of basic hand tools. Furthermore, the moldable seating system should have a number of moldable areas and the moldable areas should be moldable in varying degrees so as to provide multiple degrees of support to meet the requirements of a patient.

A further requirement is that the moldable seating system be available in a variety of sizes so that it can be used with all sizes and shapes of patients. An additional requirement of the moldable seat base of the moldable seating system is that it should provide a cutout for the coccyx area of a patient so as to avoid the potential for ulcers in that area. Other requirements are that the moldable seating system be remoldable to treat changing patient conditions and/or variations in a patient's size.

The foregoing and other features of the claimed invention will be apparent from the detailed description that follows.

DETAILED DESCRIPTION

Figure 1:
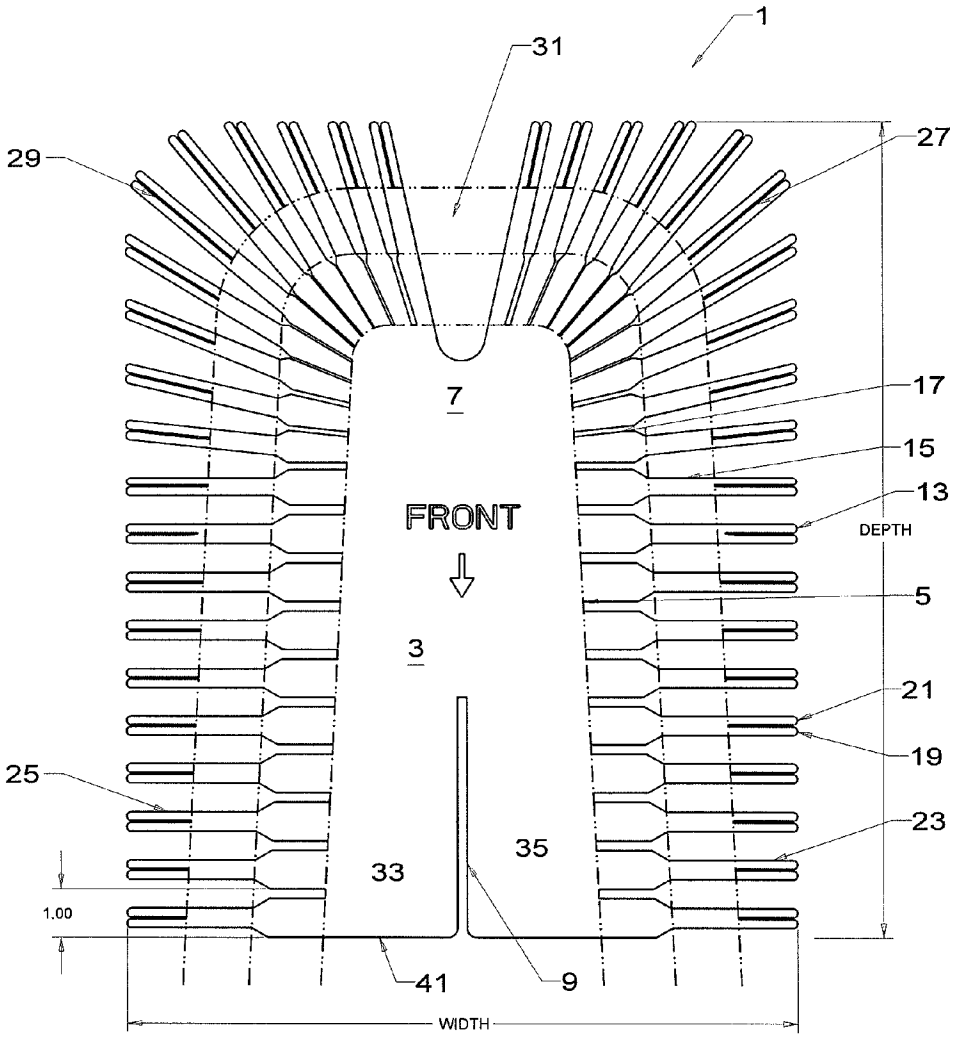
FIG. 1 is top elevational view of the moldable seat base.
Figure 3:
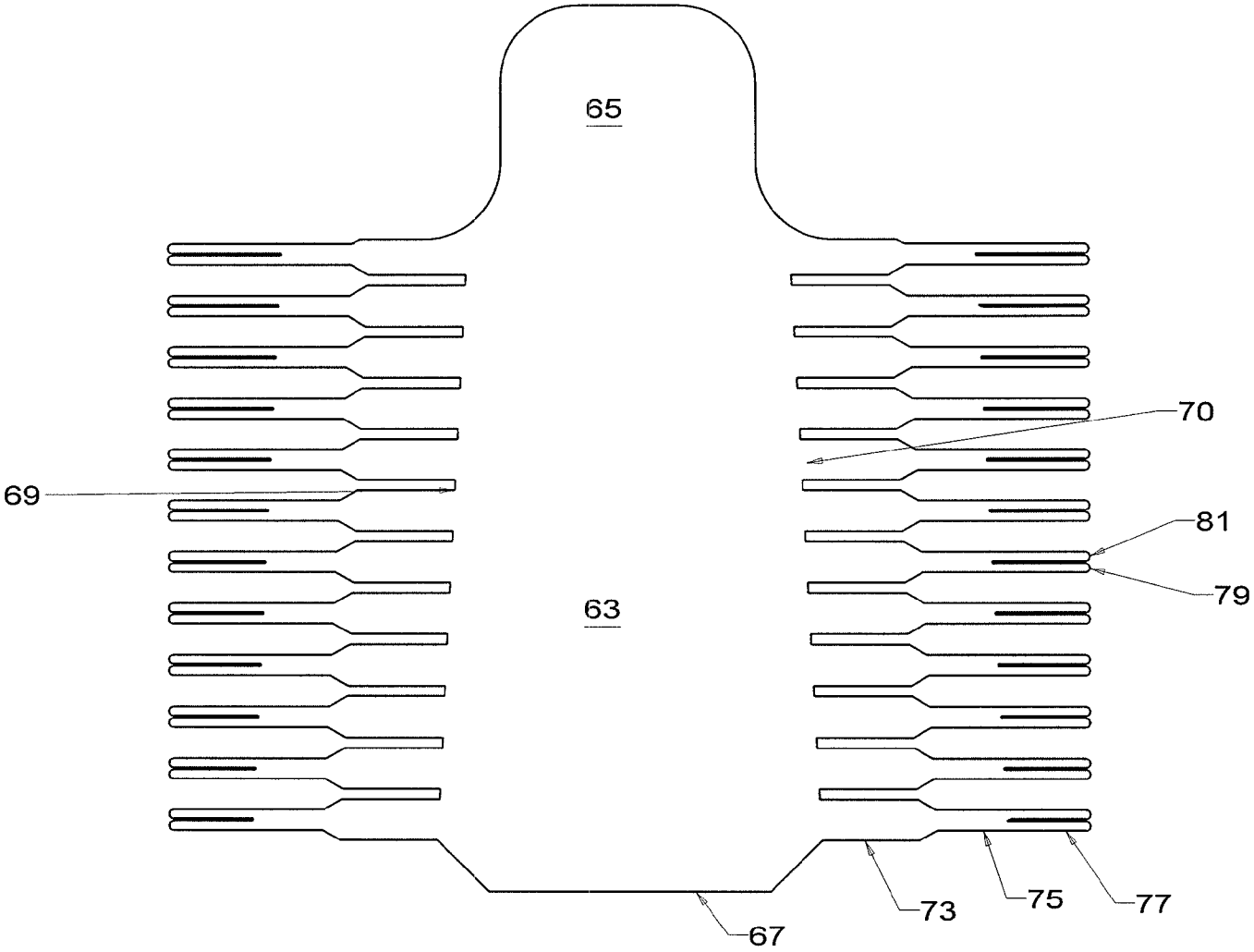
FIG. 3 is a front elevational view of the moldable backrest.
Figure 5:
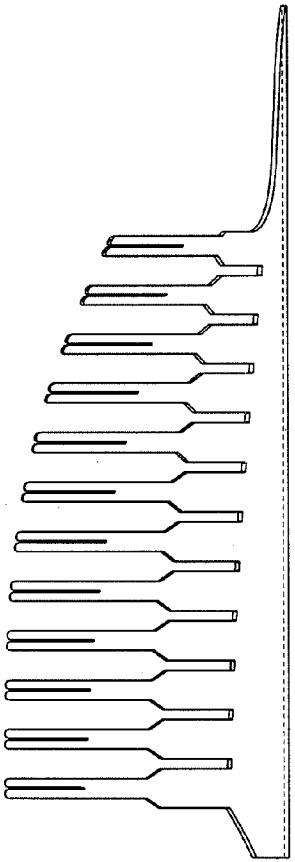
FIG. 5 is a side elevational view of a third embodiment of the moldable backrest.
Figure 4:
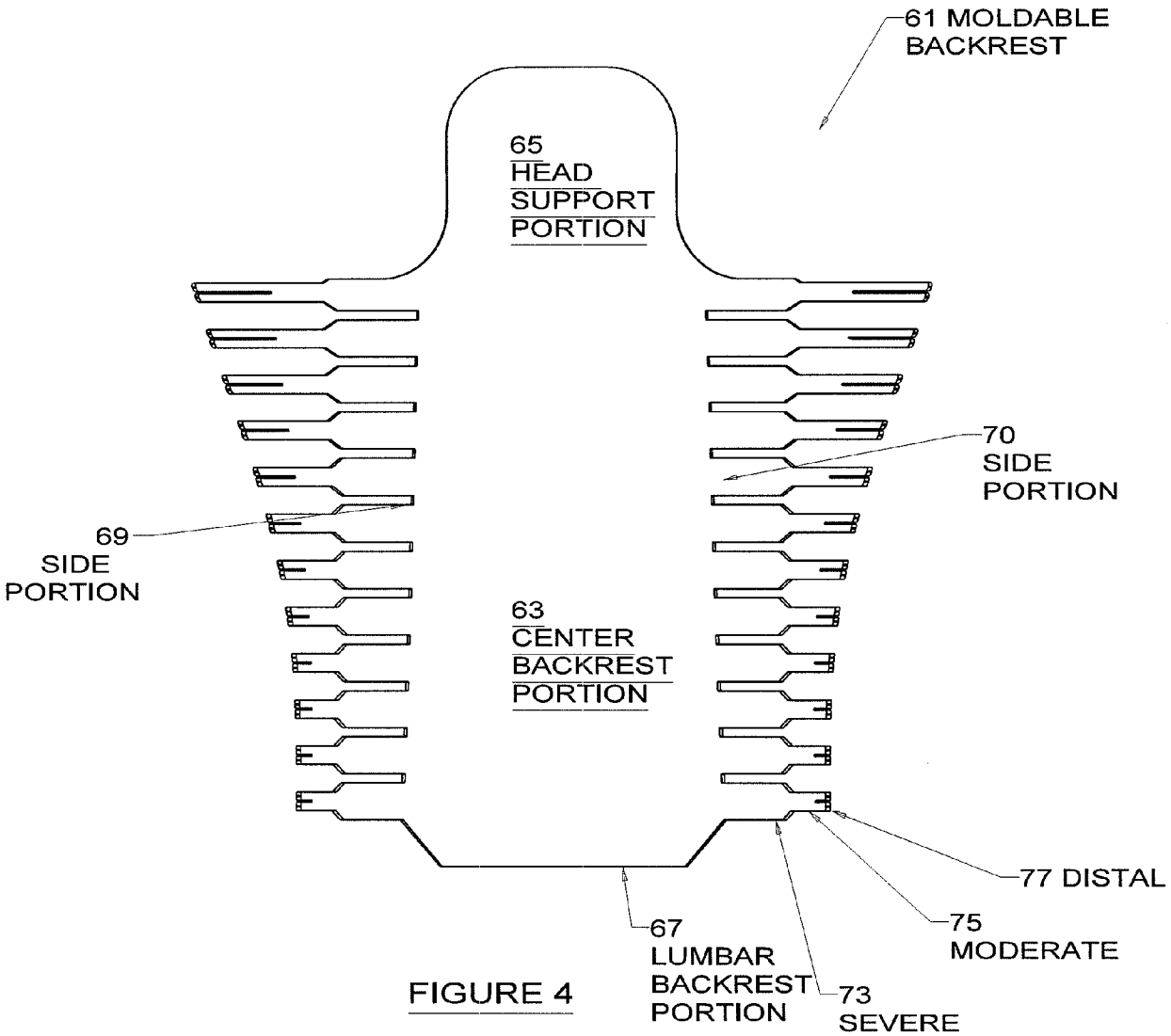
FIG. 4 is an elevational view of an additional embodiment of the moldable backrest.

Now referring to the drawings in detail, wherein like numbers refer to like elements throughout, FIG. 1 is a top view of the moldable seat base, generally identified 1. FIGS. 3-5 show additional views of the moldable backrest 61 of the claimed invention, which will be disclosed in more detail later in this detailed description.

The moldable seat base 1 largely comprises a central seat base portion 3 and a plurality of moldable fingers 11 extending outwardly from the perimeter 5 of the central seat base portion 3. In one embodiment, it may be preferable that the front seat base portion 41 is further divisible by divider 9 to create front moldable sections 33, 35 so as to treat certain posture deficiencies.

Each finger 11 is individually adjustable for varying degrees of support. In one embodiment, each finger 11 could be tapered so as to provide varying degrees of strength and adjustability throughout the length of the finger 11, although it is not required that the fingers 11 be tapered. In fact, in the case of larger individuals, it may be preferable that the fingers 11 not be tapered so as to maintain the strength of the finger throughout its length.

For example, as shown in the embodiment of the invention in FIG. 1, each finger 11 has three areas of adjustability, although more or fewer areas of adjustability could be provided. As shown, each finger 11 provides a distal mild support zone 13, a moderate support zone 15 and a proximal severe support zone 17. In the embodiment shown, the proximal severe support zone 17 is wider and more resistant to deformation. The finger 11 then tapers down between the severe support zone 17 and the moderate support zone 15 and still further to the distal mild support zone 13. Fingers 11 surround most of the outer perimeter 5 of the central seat base portion 3, with the exception of the front seat base portion 41. The rear seat base portion 7 may provide a coccyx cutout 31 where the fingers 11 are spread further apart so as to avoid the potential for ulcer creation in that sensitive and typically bony area, however such coccyx cutout is not a requirement of the claimed invention in that some patients do not require such an accommodation.

Generally speaking, the mild support zone 13 is positioned to work in the soft tissue areas of the leg, hip and buttocks. Molding the mild support zone 13 will result in a mild "hugging" effect, and is generally designed to increase the surface area of the cushion that comes into contact with a patient. To provide for an additional degree of adjustment, the mild support zone 13 is split into two generally identical smaller fingers 19, 21, each of which are independently adjustable so as to provide for an additional degree of fine tuning of support to the patient.

The moderate support zone 15 is structured to support a portion of a patient's weight. In general, the moderate support zone 15 is structured to support the weight of a patient from the midline of the patient's leg and outward. Generally speaking, molding the moderate support zone 15 will increase support to the area of the patient to which it is applied and is generally used when some level of repositioning of a patient is required.

The severe support zone 17 is structured to support a more substantial portion of a patient's weight. In general, the severe support zone 17 is used to address hip obliquities, that is, slants or unevenness in the hips that cannot be addressed through other means.

Figure 2:
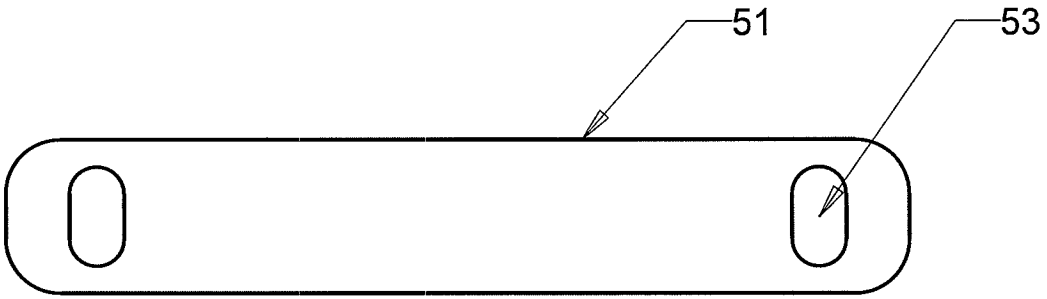
FIG. 2 is a top elevational view of the tool for manipulating the moldable seat base.

The seat base 1 is designed to be easily customizable on site to fit a patient's requirements. Therefore, the base 1 is easily moldable by hand using a standard closed end wrench or with the tool 51 that is provided with the kit, shown in FIG. 2. Customization should be performed one finger 11 at a time for best results. The tool 51 provides a slot 53 at each end. In operation, the slot 53 in the tool is placed over a finger 11 at a desired depth along the finger 11. Tool 51 is then actuated to bend a portion of the finger 11 to a desired curvature. As may be expected, it is more difficult to shape the finger in the moderate support zone 15 and the severe support zone 17 than it is in the mild support zone 13, but such shaping can still be performed with hand tools. To complete a fit of the moldable seat base 1, the fitter can simply work his/her way around each of the fingers 11 to position each of the fingers to support and comfort the patient.

The unique design of the moldable seat base 1 permits on-site customization to best fit the needs of the client. If the patient is leaning to the right then support can be added by bending the fingers 11 in the right front quadrant 25 and the right rear quadrant 29 upwardly to correct the patient. Likewise if the patient is leaning to the left, support can be added to the left front quadrant 23 and the left rear quadrant 27 by bending the fingers 11 in those quadrants upwardly. If the patient has a posterior pelvic tilt that needs correction, the fingers 11 in right rear quadrant 29 and left rear quadrant 27 can be molded for additional support. Likewise, if the patient has "windswept" legs, front left quadrant 23 and front right quadrant 25 can be adjusted to bring the patient's legs to center. As previously discussed, the front moldable sections 33, 35 may also be used to provide support and positioning.

In addition to affecting the pelvis, hips and legs, because the base is designed to essentially serve as a foundation of the body, small changes in each of the four quadrants can affect all areas of the body. For example, once the patient is centered, a therapist may be able to adjust the moldable seat base 1 to assist a patient to relax certain detrimental "fixing postures" such as kyphosis or scoliosis of the spine, adducted and internally rotated legs, contractures to the left or right, inverted or everted ankles and feet, head and neck flexes or extensions, shoulder elevations, and extension or flexing of the arms.

The moldable seating system of the claimed invention further comprises a moldable backrest 61 useful for treating and/or correcting a wide variety of positioning problems. The moldable backrest 61 of the claimed invention comprises a center backrest portion 63, a head support portion 65, a lumbar support portion 67 and side portions 69, 70. Each side portion 69, 70 provides a plurality of individually adjustable, longitudinally extending fingers 71.

Each finger 71 is independently positionable to provide support or positioning to a given area of a patient. In the embodiment shown in FIG. 4, each finger comprises a severe support zone 73, a moderate support zone 75 and a distal support zone 77. As shown in FIG. 4, the distal support zone 77 may be split into two smaller fingers 79, 81 that are independently adjustable so as to provide for a high degree of customization.

As in the case of the moldable seat base 1, the fingers 71 of the moldable backrest 61 may taper down along their length in gradual fashion or in increments, as shown in FIGS. 3-5. However, it is not necessary to provide such tapered fingers 71 and may in fact be advantageous in the case of larger patients to provide fingers 71 which do not taper along their length.

As in the case of the moldable seat base 1, the moldable backrest 61 is designed to permit on-site customization of the moldable backrest 61 to best fit the needs of the client. Like the seat base 1, the moldable backrest 61 is easily moldable by hand using a standard closed end wrench or with the tool 51 that is provided with the kit, shown in FIG. 2. Customization should be performed one finger 71 at a time for best results.

As shown in FIG. 5, the center portion 63 of the moldable backrest 61 is also moldable to correct major posture deficiencies. Likewise, the lumbar portion 67 and the heat support portion 65 of the backrest 61 are also moldable to address the posture and positioning needs of the patient.

The moldable seating system of the claimed invention is easily adaptable over time to meet changes in the size or condition of client. The flexibility and strength of the aluminum combined with the formable and reformable structure allow for multiple changes over the life of the product. This significantly reduces the likelihood of ordering the "wrong" custom cushion. If more or less support is required in one area or another it can be added or removed without resorting to an entirely new cushion. Such versatility will help to extend the life of a cushion and allow the therapist to greater serve the needs of the patient. This flexibility also allows the patient to adjust his/her position while reminding them of the position of their center, which can provide the patient with a feeling of security and freedom.

In view of the foregoing, it will be apparent that there has been provided a new, useful and non-obvious moldable seating system that is also relatively simple in its construction and installation.

What is claimed is:

1. A moldable seat base comprising:

a central seat base portion comprising a front seat base portion, a perimeter and a coccyx cutout section opposite the front seat base portion;

a plurality of individually positionable fingers being cantilevered at intervals along the perimeter of the central seat base portion and extending from the central seat base portion, each of the plurality of individually positionable fingers configured to be plastically, independently, and manually bent; each of the plurality of positionable fingers comprising a length and a width and comprising a distal support zone, a moderate support zone and a severe support zone, the thickness of each moldable finger tapering down along the length of the moldable finger in steps from the severe support zone to the moderate support zone and from the moderate support zone to the distal support zone, each of the individually positionable fingers being adjustably positionable within each of the distal support zone, the moderate support zone and the severe support zone, wherein the plurality of fingers and the central base portion are formed of one piece.

2. The moldable seat base of claim 1 wherein the distal support zone comprises two independently positionable distal support zone fingers to accommodate fine adjustment of the distal fingers.

3. The moldable seat base of claim 1 wherein the central seat base portion is moldable.

4. The moldable seat base of claim 1 wherein the thickness of each moldable finger tapers down along the length of the moldable finger in steps from the severe support zone to the moderate support zone and from the moderate support zone to the distal support zone.

* * * * *